United States Patent [19]

Larson

[11] 4,237,572

[45] Dec. 9, 1980

[54] CLEANING TOOL FOR ELECTRICAL OR GAS WATER HEATERS

[76] Inventor: Frederick A. Larson, Rte. 152, Cambridge, Me. 04923

[21] Appl. No.: 48,485

[22] Filed: Jun. 14, 1979

[51] Int. Cl.[3] ..... A47L 25/00

[52] U.S. Cl. ..... 15/105; 15/236 R; D7/184; 294/55

[58] Field of Search ..... 15/105, 105.5, 111, 15/236 R, 236 A; D7/181-185; 294/55

[56] References Cited

U.S. PATENT DOCUMENTS

| | | | |
|---|---|---|---|
| D. 244,507 | 5/1977 | Jones | D7/183 |
| 577,172 | 2/1897 | Platt | 15/105 X |
| 745,6 79 | 12/1903 | Schulze | 15/236 R |
| 778,866 | 1/1905 | Itterly | 15/105 |
| 1,093,939 | 4/1914 | Langton | 15/236 R |
| 2,634,497 | 4/1953 | Waldesbuehl | 15/236 R X |

*Primary Examiner*—Edward L. Roberts
*Attorney, Agent, or Firm*—W. G. Fasse; D. F. Gould

[57] ABSTRACT

The present cleaning tool for electrical or gas water heaters provides a scraper and a member for pulling out of the heater the scraped off scale or rust or the like that tends to deposit on the internal heater walls and bottom. In a preferred embodiment of this tool the scraper is secured to one end and the pulling out member is secured to the other end of a common handle.

8 Claims, 4 Drawing Figures

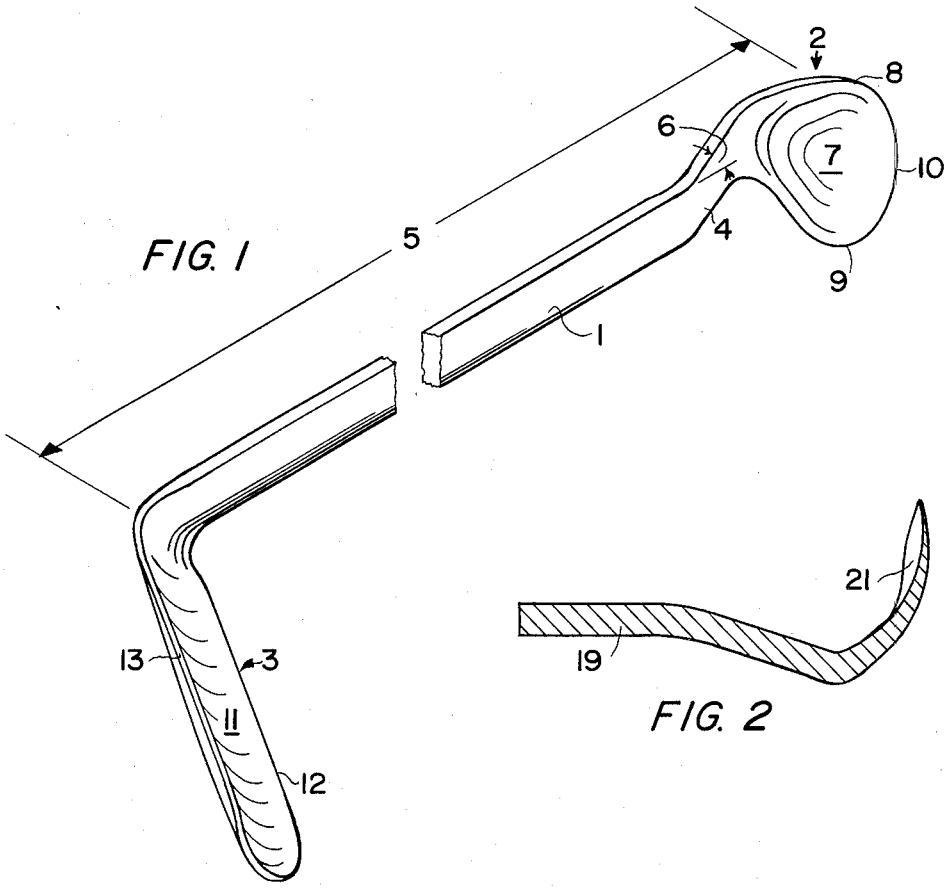
FIG. 1
FIG. 2
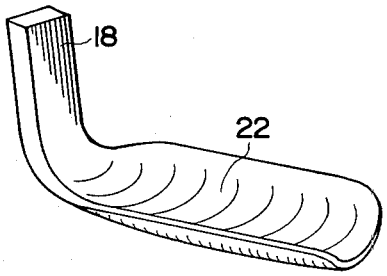
FIG. 3
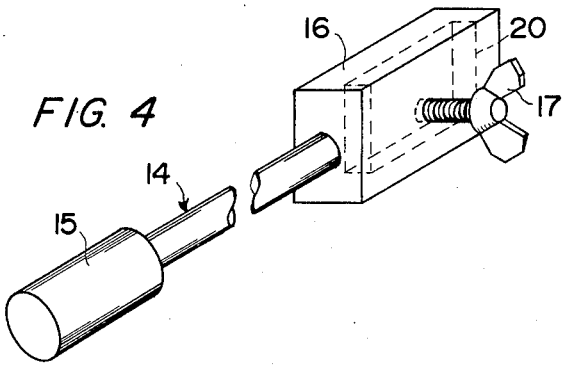
FIG. 4

CLEANING TOOL FOR ELECTRICAL OR GAS WATER HEATERS

BACKGROUND OF THE INVENTION

The present invention relates to a cleaning tool for electrical water heaters. More specifically, the present tool shall serve for removing deposits out of an electrical water heater.

It is difficult to clean electrical water heaters because the heating elements proper are normally of the screw-in type and the threaded access hole is normally just large enough for the insertion of the heater element or elements. This problem is especially aggrevated where deposits accumulate rapidly, for example, due to relatively hard or iron containing water. Thus, heretofore it was customary to bend all sorts of wires or metal rods into a makeshift tool for scraping off the deposits and pulling these scraped off deposits out of the threaded access hole. For example, wire coat hangers have been bent into a makeshift tool for this purpose. All these attempts have not been very efficient in performing the cleaning job.

OBJECTS OF THE INVENTION

In view of the above, it is the aim of the invention to achieve the following objects, singly or in combination:

to provide a cleaning tool for an electrical water heater which may be cheaply manufactured while simultaneously providing an efficient scraper as well as pulling out member;

to construct the scraper and the pulling out member in such a manner, that both may act for scraping off scale and rust deposits and that both may be used for pulling out the scraped off material through the access hole of the electrical water heater;

to manufacture the tool from readily available steel rod stock, for example, by simple forging steps; and to construct the scraper and the pulling out member so that they may be attached alternately to a common handle.

SUMMARY OF THE INVENTION

According to the invention there is provided a cleaning tool for an electrical water heater, comprising handle means, scraper means securable to said handle means, and pulling out means also securable to said handle means. The scraper and the pulling out means have a shape such that the tool is insertable into the electrical water heater for scraping off scale, rust and other deposits and for pulling out the scraped off material without causing damage to the internal structure of the electrical water heater.

Preferably the scraper, the handle, and the pulling out member are constructed as an integral unit in such a manner, that both tool ends may be used for both purposes, namely scraping and pulling scraped off material out of the water heater. For this purpose one end of the tool is shaped as a scoop with a tapering, rounded off edge secured at an angle to the longitudinal axis of the handle whereas the other end of the tool is shaped substantially rectangular but with a rounded, trough type depression facing in the longitudinal direction of the handle and toward the scoop end of the tool.

BRIEF FIGURE DESCRIPTION

In order that the invention may be clearly understood, it will now be described, by way of example, with reference to the accompanying drawings, wherein:

FIG. 1 is a perspective view of a tool according to the invention showing the embodiment, wherein the scoop type scraper and the trough type pulling out member or scraper are made as an integral structure;

FIG. 2 shows a scoop type scraper end of the present tool;

FIG. 3 shows a trough type pulling out or gathering member of the present tool; and FIG. 4 shows a handle adapted so that either the scoop or the collector may be secured to the handle.

DETAILED DESCRIPTION OF PREFERRED EXAMPLE EMBODIMENTS AND OF THE BEST MODE OF THE INVENTION

FIG. 1 shows a first embodiment of the tool according to the invention having a handle 1, a scoop 2, and a ladle type pulling out member 3. The scoop 2 is secured to the handle 1 by a bent handle section 4. Preferably the handle 1, the scoop 2, and the handle section 4 form an integral structure, for example, forged from steel rod having standard dimensions, such as, 3/16th of an inch by ½ of an inch. The ladle or pulling out member 3, which may also act as a scraper, is preferably also forged as an integral part from the rod forming the handle. The tool has an overall length 5 exceeding to some extent the diameter of an electrical water heater so that one or the other end of the tool may be conveniently inserted into the water heater and reach any zone within the heater where scale or the like may deposit. The scoop 2 extends substantially at right angles relative to the plane defined by the handle section 4. On the other hand, the handle section 4 itself extends at an angle 6 relative to the longitudinal axis of the handle 1, said angle falling within the range of about 10° to about 30°. This angle facilitates applying the scoop 2 to the inner surfaces of the water heater for the scraping action. The scoop 2 has a depression 7 and a somewhat triangular shape with rounded corners 8 and 9 tapering into a scraping edge 10. The rounded corners are also fairly sharp, so that they too may be used for the scraping action. The triangular corner opposite the scraping edge 10 merges into the handle section 4.

The ladle type pulling out member 3 is provided with a trough type depression 11 which has a substantially rectangular shape with tapering edges 12 and 13 so that the latter may also be used, if desired, for a scraping action. In addition the shape of the ladle 3 with the depression 11 is perfectly adapted to the gathering of the scraped off material to pull it toward the access hole in the water heater. As the scraped off material is accumulated inside the water heater adjacent the access hole, the scoop 2 may be used for pulling the material out of the water heater.

FIGS. 2, 3 and 4 show a modified embodiment wherein a handle 14 provided with a grip 15 at one end thereof, has a clamping member 16 at the other end thereof. A wing nut 17 is effective as a set screw to clamp the respective ends 18 or 19 in position in a recess 20 in the clamping member 16. The scoop 21 is constructed in the same manner as the scoop 2 of FIG. 1. The same applies to the ladle 22 which has the same shape and function as the ladle 3 of FIG. 1 including the scraping edges and the depression. The outer dimensions of the clamping member and its shape will be such as to fit through the heater access hole.

Although the preferred embodiment would be a tool forged from standard steel rod stock, the tool could also be made from aluminum or hard plastics material. In the use of such materials it may be advisable to reinforce or harden the scraping edges.

Further, in FIG. 1 the two tool ends 2 and 3 substantially face each other. However, the tool ends could also be bent in opposite directions, so that they do not face each other, without departing from the present teaching.

Although the invention has been described with reference to specific example embodiments, it will be appreciated, that it is intended to cover all modifications and equivalents within the scope of the appended claims. Thus, the invention is not limited to electrical water heaters, rather the present tool is suitable for all types of heaters in which removal of deposits has been a problem heretofore.

What is claimed is:

1. A cleaning tool for a water heater having a given diameter and an interior zone to be cleaned, comprising handle means having a longitudinal axis, scraper means securable to said handle means, and pulling out means also securable to said handle means, said scraper means and said pulling out means having a shape insertable into said electrical water heater for the intended purpose without causing damage to the internal structure of said electrical water heater, said scraper means having a substantially triangular shape including two substantially rounded scraping corners and a third corner, said tool further comprising an intermediate handle section operatively interposed between said handle means and said third corner of said scraper means, said intermediate handle section extending at an angle relative to said longitudinal axis of said handle means, said angle being within the range of about 10° to about 30° said pulling out means comprise an elongated, substantially rectangular member extending substantially at a right angle relative to the longitudinal axis of said handle means, said substantially rectangular member having tapering substantially parallel, longitudinal scraping edges.

2. The tool of claim 1, wherein said handle means comprise means for securing said scraper means and said pulling out means to the same handle means, said handle means having a length relative to said heater diameter such that substantially the entire interior heater zone, where deposits may accumulate, may be cleaned.

3. The tool of claim 1, wherein said scraper means are secured to one end of said handle means whereas the pulling out means are secured to the opposite end of said handle means.

4. The tool of claim 3, wherein said handle means, said scraper means and said pulling out means form an integral structural unit.

5. The tool of claim 4, wherein said integral structural unit is forged from flat strip steel stock having initial cross-sectional dimensions of about 3/16th of an inch to about 1/2 of an inch.

6. The tool of claim 1, wherein said substantially triangular shape of said scraper means has sides of substantially equal length.

7. The tool of claim 1, wherein said triangular shape of said scraper means has a spoon type depression facing in the direction of the longitudinal axis of said handle means, said scraper means further having a tapering edge extending along one side of said triangular shape between and around said two rounded corners to provide for a scraping capability along said tapering edge.

8. The tool of claim 1, wherein said substantially rectangular member comprises a depression extending lengthwise of said member whereby said longitudinal, tapering edges face in the direction of the longitudinal axis of said handle means.

* * * * *